US006293980B2

(12) United States Patent
Wei et al.

(10) Patent No.: US 6,293,980 B2
(45) **Date of Patent: *Sep. 25, 2001**

(54) PRODUCTION OF LAYERED ENGINEERED ABRASIVE SURFACES

(75) Inventors: Paul Wei, Latham; Gwo Shin Swei, East Amherst; Wenliang Patrick Yang, Ballston Lake, all of NY (US)

(73) Assignee: Norton Company, Worcester, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/466,974

(22) Filed: Dec. 20, 1999

(51) Int. Cl.[7] ..... B24D 3/00; B24D 18/00

(52) U.S. Cl. ..... 51/298; 51/295; 51/307; 51/309

(58) Field of Search ..... 51/295, 298, 307, 51/309, 293; 428/144, 148, 143

(56) References Cited

U.S. PATENT DOCUMENTS

| | | | | |
|---|---|---|---|---|
| 4,644,703 | * | 2/1987 | Kaczmarek et al. | 51/298 |
| 4,737,163 | * | 4/1988 | Larkey | 51/298 |
| 5,437,754 | * | 8/1995 | Calhoun | 51/293 |
| 5,549,962 | * | 8/1996 | Holmes et al. | 51/298 |
| 5,833,724 | | 11/1998 | Wei et al. | 51/307 |
| 5,863,306 | | 1/1999 | Wei et al. | 51/295 |
| 5,928,394 | * | 7/1999 | Stoetzel | 51/295 |

* cited by examiner

*Primary Examiner*—Michael Marcheschi
(74) *Attorney, Agent, or Firm*—David Bennett

(57) ABSTRACT

Coated abrasives comprising shaped structures deposited on a backing can be given increased versatility can be made by a process in which the shaped structure is imposed on a structure deposited in layers on the backing before the shaped structures are formed such that different characteristics are revealed as the structure is eroded during use.

4 Claims, 2 Drawing Sheets

PRODUCTION OF LAYERED ENGINEERED ABRASIVE SURFACES

BACKGROUND OF THE INVENTION

This invention relates to the production of coated abrasives engineered to have patterned surfaces with properties specific to the desired application.

The proposal to deposit isolated structures such as islands of a mixture of a binder and abrasive material on a backing material has been known for many years. If the islands have very similar heights above the backing and are adequately separated then, (perhaps after a minor dressing operation), use of the product will result in reduced surface scratching and improved surface smoothness. In addition the spaces between the islands provide a route by which swarf generated by the abrasion can be dispersed from the work area.

In a conventional coated abrasive, investigation of the grinding surface reveals that a comparatively small number of the surface abrasive grits in an active abrading zone are in contact with the workpiece at the same time. As the surface wears, this number increases but equally the utility of some of those abrasive grits may be reduced by dulling. The use of abrasive surfaces comprising a uniform array of isolated islands has the advantage that the uniform islands wear at essentially the same rate such that a uniform rate of abrasion can be maintained for longer periods. In a sense the abrading work is more evenly shared among a larger number of grinding points. Moreover since the islands comprise many smaller particles of abrasive, erosion of an island uncovers new, unused abrasive particles which are as yet undulled.

One technique for forming such an array of isolated islands or dots that has been described is that of the rotogravure printing. The technique of rotogravure printing employs a roll into the surface of which a pattern of cells has been engraved. The cells are filled with the formulation and the roll is pressed against a surface and the formulation in the cells is transferred to the surface. Normally the formulation would then flow until there was no separation between the formulations deposited from any individual cell. Ultimately a layer of essentially uniform thickness would be obtained. By way of illustration, comparative Examples C and D of U.S. Pat. No. 5,152,917 describe a process in which the pattern obtained by a rotogravure process quickly lost all separation of the individual amounts deposited from the cells.

In U.S. Pat. No. 5,014,468 a binder/abrasive formulation was deposited from rotogravure cells on a roller in such a way that the formulation was laid down in a series of structures surrounding an area devoid of abrasive. This is believed to be the result of depositing less than the fill volume of the cell and only from the perimeter of each cell, which would leave the ring formations described.

The problem with the rotogravure approach has therefore always been the retention of a useful shape to the island. To formulate an abrasive/binder mixture that is sufficiently flowable to be deposited and yet sufficiently non-flowable such that it does not slump to an essentially uniform layer coating when deposited on a substrate has proved very difficult.

Chasman et al.,in U.S. Pat. No. 4,773,920 disclosed that using a rotogravure coater, it is possible to apply a uniform pattern of ridges and valleys to the binder composition which, when cured, can serve as channels for the removal of lubricant and swarf. However beyond the bare statement of possibility, no details are given that might teach how this might be carried out.

In U.S. Pat. No. 4,644,703 Kaczmarek et al. used a rotogravure roll in a more conventional fashion to deposit an abrasive/binder formulation to deposit a layer that is then smoothed out before a second layer is deposited by a rotogravure process on top of the smoothed-out first layer. There is no teaching of the nature of the final cured surface.

Another approach has been to deposit the abrasive/binder mixture on a substrate surface and then impose a pattern comprising an array of isolated islands on the mixture by curing the binder while in contact with a mold having the inverse of the desired patterned surface. This approach is described in U.S. Pat. Nos. 5,437,754; 5,378,251; 5,304,223 and 5,152,917. There are several variations on this theme but all have the common feature that each island in the pattern is set by curing the binder in contact with a molding surface.

Yet another approach is described in U.S. Pat. No. 5,863,306 in which a pattern is embossed on a surface of a layer comprising a radiation-curable binder having abrasive particles dispersed therein after the surface of the layer has been modified to increase its viscosity but before curing of the binder has been initiated.

The present invention presents a technique for tailoring the formulation formed into patterns to generate grinding properties that vary with the degree of wear the coated abrasive has experienced.

The present invention therefore provides a flexible and effective route for the production of products uniquely suited to a specific task such that multiple abrading/fining/polishing operations can be avoided.

GENERAL DESCRIPTION OF THE INVENTION

The present invention provides a coated abrasive having a patterned surface comprising a plurality of shaped structures wherein each such structure comprises a curable binder with abrasive particles dispersed therein wherein the improvement comprises providing that the structures are layered such that, as the structure is eroded during use, different properties are revealed.

The term "shaped structure" is intended to convey a structure having a defined contoured shape that is raised above a backing surface upon which the structure is located. A "patterned surface" is a surface comprising a plurality of such shaped structures disposed on a backing surface in a repeating pattern with each shaped structure having a height dimension above the backing surface such that an initial contact plane is defined parallel to the backing surface and passing through only the tops of shaped structures. In preferred patterned surfaces at least 50% of the tops of the shaped structures lie in the initial contact plane. The shape of each "shaped structure" can be exactly replicated either across the whole of the patterned surface or in a number of groups of different repeating shaped structures, each structure within a group being identical, in defined or randomized patterns. Alternatively the shapes may be less exactly replicated as would be the case if an instrumentality imposing the shape were to be removed before the material shaped had completely lost the ability to flow.

The layers which make up the shaped structures comprise a curable binder and, dispersed therein, a particulate material. The nature and/or the amount of the particulate material varies within the shaped structure so as to achieve different properties at different layers of the structure as indicated above.

U.S. Pat. No. 5,863,306 shows a form of this approach in which the structures comprise abrasive particles dispersed in a UV-curable binder and the concentration of the abrasive in the surface layers of an abrasive structure is increased by comparison with the rest of the structure by for example application to the uncured binder/abrasive formulation surface a layer of a functional powder which, during an embossing process to form the shaped structures becomes at least partially incorporated into the surface layer of the structure. The functional powder can be, for example, abrasive particles or particles of a grinding aid or a mixture of both. This approach is described generically in U.S. Pat. No. 5,833,724. In each case the size of the powder particles laid on the surface was the same as or finer than or coarser than the abrasive particles within the shaped structure.

It is also known to deposit layers of grinding adjuvants on the surface of a patterned abrasive in the form of a supersize layer or even a "diamond-like" layer. These are however layers deposited on top of shaped structures rather than forming part of the structures themselves as is the case in the present invention.

The layers from which the shaped structures are built up need not be separately identifiable in a cross-section but can in fact merge into one another to give a gradual transition from one to the next. This is in fact to be expected if the layers are laid down sequentially while the layers below are still fluid. Each layer preferably comprises a curable resin binder in which an active component is dispersed. In this context an "active component" is a component that fulfils a function such as an abrasive, a grinding aid, a wear indicator, a filler, a cure agent or an anti-static additive.

A major component of formulations from which the layers are formed is the binder. This is a curable resin formulation preferably selected from radiation curable resins, such as those curable using electron beam, UV radiation or visible light, such as acrylated oligomers of acrylated epoxy resins, acrylated urethanes and polyester acrylates and acrylated monomers including monoacrylated, multiacrylated monomers, and thermally curable resins such as phenolic resins, urea/formaldehyde resins and epoxy resins, moisture curable resins, as well as mixtures of such resins. The preferred curing mechanism is through UV light with or without the assistance of an additional thermal cure mechanism.

It is often convenient to have a radiation curable component present in the formulation that can be cured relatively quickly after the formulation has been shaped so as to add to the stability of the shape. In the context of this application it is understood that the term "radiation curable" embraces the use of visible light, ultraviolet (UV) light and electron beam radiation as the agent bringing about the cure. In some cases the thermal cure functions and the radiation cure functions can be provided by different functionalities in the same molecule. This is often a desirable expedient.

The resin binder formulation can also comprise a non-reactive thermoplastic resin which can enhance the self-sharpening characteristics of the deposited abrasive composites by enhancing the erodability. Examples of such thermoplastic resin include polypropylene glycol, polyethylene glycol, and polyoxypropylene-polyoxyethylene block copolymer, etc.

Fillers can be incorporated into the abrasive formulation to modify the rheology of formulation and the hardness and toughness of the cured binders. Examples of useful fillers include: metal carbonates such as calcium carbonate, sodium carbonate; silicas such as quartz, glass beads, glass bubbles; silicates such as talc, clays, calcium metasilicate; metal sulfate such as barium sulfate, calcium sulfate, aluminum sulfate; metal oxides such as calcium oxide and alumina bubbles; and aluminum trihydrate.

The abrasive particles can be selected from those typically used is such products including fused alumina, sintered alumina, alumina-zirconia, silicon carbide, diamond, CBN and for applications such as polishing or buffing or the finishing of optical or electronic surfaces, gamma alumina, silica or ceria. Other additives that might be added included grinding aids which usually contain components that, under grinding conditions, liberate chemicals that render the surface more susceptible to abrading. Typical compounds liberate halogens or halogen acids or sulfur oxides. Other possible components include: 1) fillers—calcium carbonate, clay, silica, wollastonite, aluminum trihydrate, etc.; 2) grinding aids—$KBF_4$, cryolite, halide salt, halogenated hydrocarbons, etc.; 3) anti-loading agents—zinc stearate, calcium stearate, etc., 4) anti-static agents—carbon black, graphite, etc., 5) lubricants—waxes, PTFE powder, polyethylene glycol, polypropylene glycol, polysiloxanes etc.

The shaped structures preferably used in the coated abrasives forming part of this invention typically are widest at the base and decrease in cross-section with distance from the substrate upon which they are deposited. Thus as the structure erodes, a larger grinding surface is exposed. In products according to the prior art the size of the abrasive grits remains unchanged and this means that the grits in the lower portion of the structures will not work quite so efficiently as the individual pressure on each grit will be reduced. This is inefficient and can lead to variations in cut rate during use. The present invention avoids this result by tailoring the composition of the lower levels to ensure that the desired cut rate and the desired finish can be obtained efficiently in a single operation.

The pattern in which the shaped structures are arranged can comprise isolated islands of formulation, or a pattern of ridges separated by valleys or a plurality of connected ridges. The patterns are generally designed to provide an abrasive product with a plurality of abrading surfaces, (that is portions of the pattern that contact the surface of the workpiece when the abrasive product is in use), that are more or less equidistant from the backing. Obviously the total area of abrading surface increases with erosion of the layer unless the formation has uniform width from the backing to the abrading surface. Between the abrading surfaces, channels allow circulation of grinding fluids and removal of swarf generated by the abrasion. Channels also allow for momentary cooling before the surface is contacted by the next abrading surface.

The surface structures of the coated abrasive of the present invention can be created by any process adapted to the shaping of a structure whose composition varies with distance from the backing surface. Thus a process in which a sequence of horizontal layers of varying composition is deposited on a surface of a backing material and thereafter a shape is imposed on the layers to give a patterned surface, is in accordance with the present invention. Such imposition could be by molding the deposited layers. The molding process referred to above could also include a process in which the consecutive layers are deposited through a mask on the surface of the backing which remains in place until the binder components of the layers have been cured.

The structures can also be formed by an embossing process accomplished using an embossing tool such as a plate forced into contact with the layer of formulation or, often more simply, the tool can comprise a roller with the desired pattern engraved on its surface which when contacted with the slurry formulation imposes the reverse of the pattern engraved on the surface.

Another means of forming the structures includes the technique known as "free-forming". In free-forming the final structure is built up in a sequence of deposited layers with the pattern of deposition being controlled to result in a structure having the desired shape. By varying the composition of the material deposited in sequential layers a product according to this invention can be obtained.

Yet another forming mechanism employs a substrate that is contoured, that is to say has a relief pattern formed on its surface for example by an embossing process. Layers deposited on this contoured surface would then adhere to the contours to give a pattern of shaped structures. Such a process is extremely versatile since the pattern on the substrate can be varied readily and the need for a very hard, abrasion resistant tool to impose a shape in a highly abrasive material would be avoided. To avoid the problem of the formulation comprising the layer collecting in the spaces between the shapes on the patterned backing, it is desirable to deposit each layer in the form of an extruded film that adheres and conforms to the surface of the patterned backing or the most recent layer previously deposited thereon.

DESCRIPTION OF PREFERRED EMBODIMENTS

Figure 1:
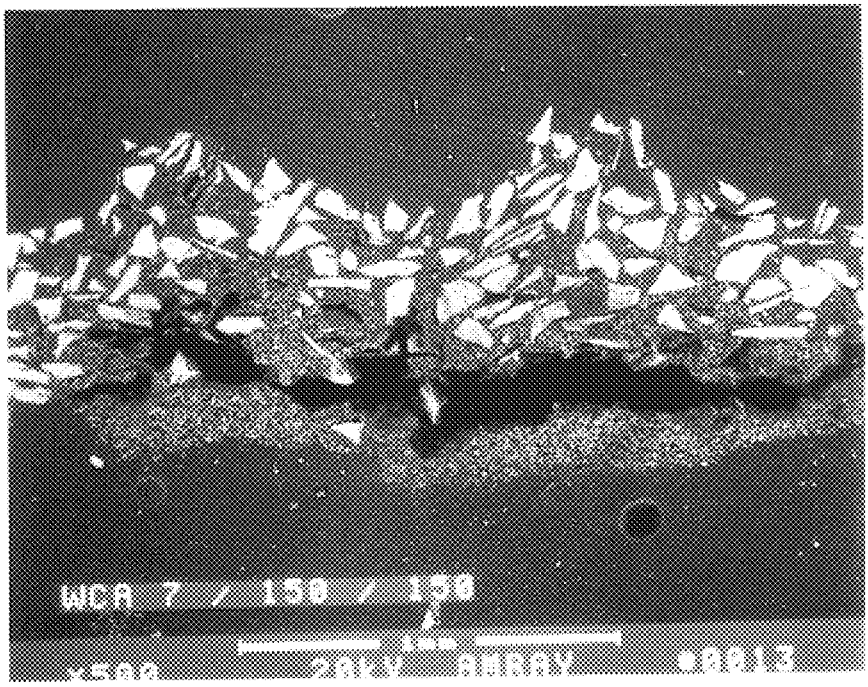
FIGS. 1–4 are SEM photographs, taken at 50× magnification, of crosssections of abrasive sheets made according to the invention.

The present invention differs from the prior art approaches in which a shaped structure is given a surface coating of a different composition. According to the present invention the composition of the actual shaped structure is varied so as to yield different characteristics as wear progresses. A preferred way in which this can be done is by decreasing the size of the abrasive particles in the lower portion of the structure. In this an initial rapid aggressive cut as a result of the use of a relatively coarse grit at the surface, (which would produce a relatively rough finish), would be followed by a polishing action as a result of the use of much finer abrasive particles in the layers exposed after erosion of the upper layers of the structure.

Alternatively and sometimes preferably the grains closer to the backing can be made coarser to make the cut rate at constant applied pressure more uniform with the more aggressive cutting larger grits compensating for the larger contact area as the abrasive structure wears down.

Besides varying the abrasive characteristics of the coated abrasive as erosion of the structure proceeds by changing the grit size, it is also possible to include additives in the lower levels having specific properties. For example it is possible to provide that the lower layer comprise a conductive material such as carbon black or graphite to inhibit the build up a static electricity during abrading.

It is also possible to incorporate in the lower levels of the structure an erodable filler to ensure that abrasive particles in that part of the structure are part of a more open structure that permits the particles to work more efficiently.

The use of conventional patterned coated abrasive structures is rarely continued until the backing is exposed such that it is often useful and economic to provide that the lowest levels, whose function is merely support for the upper levels, comprises no abrasive at all or alternatively a lower quality and/or less costly abrasive or even only a filler.

It is also a useful variation to provide that the different layers of the structure have a different color such that the state of wear of the abrasive structure can be readily determined by visual examination.

Where the finished structure comprises a cured binder material, it is often convenient to include cure initiators or catalysts in amounts that reflect the distance from the source of the curing mechanism. For example if the binder is a UV-curable resin and the overall thickness of the structure is significant, it can be convenient to include in the lower levels a higher level of initiator or perhaps an initiator that is responsive to the heat generated during cure of the upper levels. The objective is to ensure complete cure throughout the shaped structure and all additive/initiator variations that promote this objective are within the intended scope of this invention.

The invention is now described with particular reference to the Drawings. Examples 1–4 below detail the production of the products illustrated in FIGS. 1–4 respectively.

General Process Operations

A cloth substrate was prepared and a first layer of a slurry comprising fused alumina abrasive grain dispersed in a UV-curable binder formulation, (a resin mixture of 30% Ebecryl 3700 acrylated epoxy oligomer and 70% TMPTA monomer with 4% Irgacure 819 photoinitiator based on the resin weight), was deposited on the substrate using a knife blade coater with a gap of 10 mil, (0.25 mm). A second layer of slurry was then deposited over the first layer. The second layer contained abrasive particles of a different size from those in the first layer. The curable binder formulation was however the same and the deposition technique was the same except that a gap of 20 mil, (0.51 mm) was used.

A surface layer of abrasive particles was then deposited on top of the second layer. The particle size in this layer can be the same as one of the previous layers or different.

The surface was then embossed using a rotogravure roll engraved with a 25 lines per inch trihelical pattern and the embossed surface was immediately subjected to UV cure conditions using a 400 W/inch "V" bulb and a 300 W/inch "D" bulb at a speed of 50 ft/minute.

Figure 2:
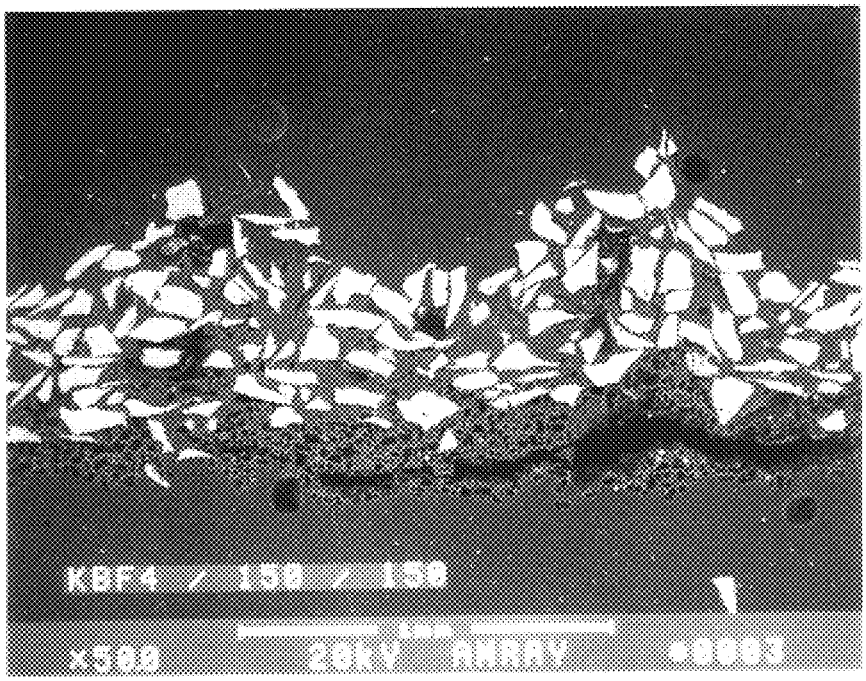

The UV-cured, abrasive-containing layers of the samples were then peeled from the substrate and a cross-section made and polished for SEM photography. In some cases this resulted in minor damage to the first layer, especially where the first or lower layer comprised a very fine grit particulate material such as in Examples 1 and 2 as shown in FIGS. 1 and 2.

EXAMPLE 1

First layer: 7 micron alumina in a 68% solids slurry.

Second layer: 97 micron alumina in a 70% solids slurry

Surface Powder layer: 97 micron alumina.

In FIG. 1 it is possible to distinguish clearly the first layer from the second but the surface powder layer can not readily be distinguished from the second layer except by the absence of binder all round the grains on the surface.

EXAMPLE 2

First layer: 20 micron potassium fluoroborate in a 65% solids slurry.

Second layer: 97 micron alumina in a 70% solids slurry

Surface Powder layer: 97 micron alumina.

In FIG. 2 it is possible to distinguish the $KBF_4$ layer wherein the particles are darker but again the second layer and the powder layer, having the same abrasive particles included are distinguished only by their location at the surface of the binder layer.

EXAMPLE 3

First layer: 97 micron alumina in a 70% solids slurry.

Second layer: 7 micron alumina in a 68% solids slurry

Surface Powder layer: 7 micron alumina.

Figure 3:
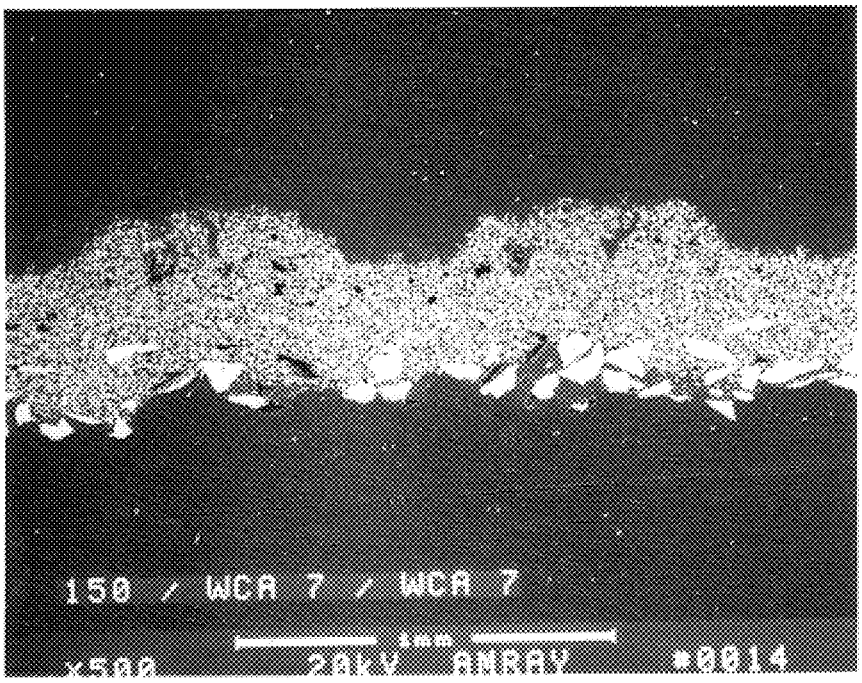

FIG. 3 shows the cross-section of this product.

EXAMPLE 4

First layer: 97 micron alumina in a 70% solids slurry.

Second layer: 7 micron alumina in a 68% solids slurry

Surface Powder layer: 97 micron alumina.

Figure 4:
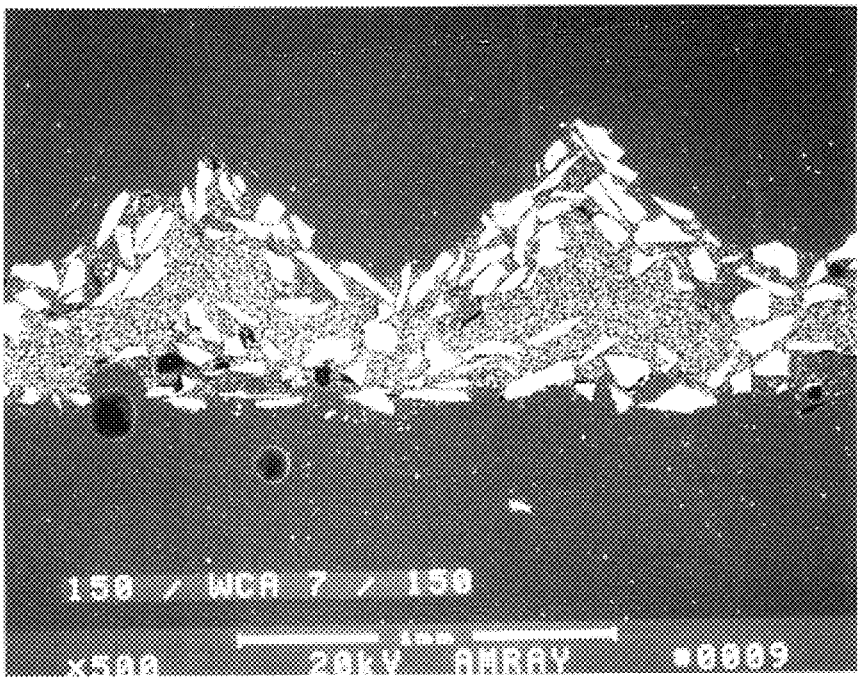

FIG. 4 shows the delineation of the various layers quite clearly by virtue of the different sizes.

What is claimed is:

1. A process for the production of a coated abrasive having a patterned surface which comprises depositing upon a backing and in sequential order, a plurality of layers each layer comprising a curable binder with abrasive particles dispersed therein and thereafter forming the deposited layers into a plurality of shaped structures and thereafter completing the cure of the curable binder component of each layer, the composition of the layers being such that, as the structure is eroded during use, different properties are revealed.

2. A process according to claim 1 in which the abrasive particles are selected such that the abrading properties of the coated abrasive changes as the structures are eroded.

3. A process according to claim 1 comprising incorporating abrasive particles in the layer closest to the backing that are finer than those in any layer more remote from the backing.

4. A process according to claim 1 in which the layer closest to the backing is provided with a color that is different from that of any layer more distant from the backing.

* * * * *